US005262004A

United States Patent [19]

Gilbert et al.

[11] Patent Number: 5,262,004

[45] Date of Patent: Nov. 16, 1993

[54] METHOD OF EXTRACTING CHEMICAL PRESERVATIVES FROM TREATED WOOD

[75] Inventors: Roland Gilbert, Boucherville; André Besner, Montréal; Pierre Tetreault, St-Hubert, all of Canada

[73] Assignee: Hydro-Quebec, Montreal, Canada

[21] Appl. No.: 914,546

[22] Filed: Jul. 16, 1992

[30] Foreign Application Priority Data

May 29, 1992 [CA] Canada ..... 2069984

[51] Int. Cl.[5] ..... D21B 1/12

[52] U.S. Cl. ..... 162/22; 162/12; 162/90; 162/189

[58] Field of Search ..... 162/21, 22; 24, 189, 162/90, 100; 427/297, 298; 428/528, 541; 210/768, 761, 806, 611; 241/28

[56] References Cited

U.S. PATENT DOCUMENTS

| | | | |
|---|---|---|---|
| 3,878,994 | 4/1975 | Tee | 241/24 |
| 4,666,612 | 5/1987 | Hoffman et al. | 162/89 |
| 4,797,135 | 1/1989 | Kubat et al. | 44/500 |
| 4,798,651 | 1/1989 | Kokta | 162/22 |
| 5,028,229 | 7/1991 | Guidat et al. | 162/24 |
| 5,029,299 | 7/1991 | Rodgers | 330/298 |

*Primary Examiner*—W. Gary Jones
*Assistant Examiner*—Dean Tan Nguyen
*Attorney, Agent, or Firm*—Oblon, Spivak, McClelland, Maier & Neustadt

[57] ABSTRACT

Preservatives and oil are extracted from treated wood. For this purpose, treated wood that is intended to be discarded is comminuted, the chips are impregnated with an alkaline solution until softening of the chips and modification of the chemical state of the products to be extracted. Possibly, the chips may be treated with saturated steam at a temperature between 170° C. and 210° C. followed by an explosive decompression giving wood fragments. This is followed by a refining operation in a crusher permitting the grinding of the wood. The result is a substantial release of the preservatives and oil from the wood chips which are at least partly disintegrated. The chemical preservatives and the oil are collected separately from the wood chips in the aqueous phases which are produced in the impregnation, steam cooking-explosive decompression and refining steps.

10 Claims, No Drawings

METHOD OF EXTRACTING CHEMICAL PRESERVATIVES FROM TREATED WOOD

BACKGROUND OF THE INVENTION

1. Field of the Invention

The present invention concerns the extraction of chemical products, such as wood preservatives, for example, wood posts used in electrical and/or telephone networks, sleepers, and above all any wood article which has undergone a chemical treatment to ensure its preservation and for which discarding is necessary. More particularly, the present invention relates to a process aiming at rendering non toxic a wood which has been treated with pentachlorophenol (PCP) or with any other preservation chemical product (creosote, etc), which process consists in extracting said pentachlorophenol (PCP) or other product (oil, etc) from a wood treated object in order to ultimately give a wood which, after extraction, ceases to constitute a toxic waste according to the environmental regulations presently in force.

2. Description of Prior Art

The destruction of posts treated with pentachlorophenol, by incineration or burying in the ground, is not possible under the present context of environmental concerns, which gives no other alternative to the users than the storage of discarded posts. This alternative involves however a possibility of a risk of contamination which is not negligible on a medium term, and does not constitute a final solution. Since a large number of posts are discarded each year when dismantling or replacing electrical and/or telephone lines or the like, it becomes essential to find a solution to the problem mentioned above, while reducing the risks of contamination to the environment.

The setting up of a treatment center with mechanical, chemical, biological and other means would enable to effect the treatment recommended above; however, such a center would require important investments which would limit the establishment of an important number of plants. Furthermore, one would have to rely on long distance transportation of these articles and even across a border, which would not be necessarily acceptable for the authorities which are responsible for the environment.

A simple and cheap solution, which would involve a technology which has already been tested for other aims, and which could be used locally would by far be desirable by users.

Certain methods of treating wood wastes in order to convert them into useful products, or methods which are used with muds containing preservatives are known, however none of them appear to be capable of solving the problem mentioned above.

Already in 1900, it was suggested to treat used tapestry making devices by treatment with an alkaline solution, followed by steps of washing, bleaching and drying to give a pulp. Reference is particularly made to U.S. Pat. No. 659,715 issued Oct. 16, 1990, inventor Bendix Themans.

U.S. Pat. No. 3,878,994 issued on Apr. 22, 1975, inventor Lion-Hian Tee, describes a method for treating wood waste which would enable to obtain chips which can be used for example in the manufacture of agglomerated panels. This method includes a series of mechanical operations including a reduction of the volume of the wastes by mechanical impact, a coarse separation of the material by flotation, a transformation into chips by crushing, an elimination of the metallic pieces by passing the chips over a screen, a separation of the chips as a function of their size and finally, a washing. This process is limited to the treatment of wood wastes containing no chemical preservatives. Obviously, this process could not be used to extract toxic products from wood.

U.S. Pat. No. 4,666,612 issued on May 19, 1987, inventors Donald G. Hoffman and Thomas L. Hurst, aims at the recovery of preservatives which are present in the aqueous wastes derived from wood treatment plants in order to re-use chemical products. This process is concerned with an intricate method consisting in leading the process liquid wastes to an outside decantation vat and separating the solid and liquid layers which are formed in order to treat them separately in different manners. In this process, the preservatives are concentrated in large part in the solid decantation layer. Again, this is an intricate method which is mainly intended at treating preservatives containing mud.

On the other hand, U.S. Pat. No. 4,797,135 issued Jan. 10, 1989, inventors Josef Kubat and Lars M. Qvist, concerns the pulverization of wood and other types of biomass into powder in order to constitute a fuel for boilers, gas turbines, diesel engines, etc. This method includes pulverizing the original cellulosic material into coarse particles, treating them with an alkaline solution to soften them, exposing them to high temperature, drying them and again pulverizing them to give a powder of adequate granulometry. This process is not at all intended to extract toxic products contained in treated wood.

In U.S. Pat. No. 4,798,651, issued Jan. 17, 1989, inventor Bohuslav Kokta, there is described a method for the preparation of pulp, based on the impregnation of wood chips with an alkaline solution containing an anti-oxidizing agent such as sodium sulfite, followed by a treatment with saturated steam at high temperature and pressure followed by an explosive decompression to give wood particles which are washed and refined to give a pulp.

Finally, U.S. Pat. No. 5,029,299, issued Jul. 2, 1991, inventors Gilbert Guidat and Claudine G. De Queiroz, describes an intricate plant for the production of wood particles including a step of coarse mechanical reduction of the wood wastes, followed by a heat treatment in a rotary oven, a supplementary step of mechanical reduction of the cellulosic material, a chemical treatment of the particles with salts and finally bagging of the finished product.

To this day there is no description of an efficient method, which is easy to use and is of simple design enabling to extract chemical preservatives from wood products.

SUMMARY OF INVENTION

It is therefore an object of the invention to provide a method which is simple, efficient and inexpensive enabling to extract preservatives from wood, such as from posts of electrical and/or telephone lines or the like.

It is also an object of the invention to recover toxic additives from wood posts which are discarded while giving a fibrous material which can easily be disposed in burying sites without fear of causing harm to the environment, which is not the case for the starting material.

The invention concerns a method for treating wood articles, such as posts of electrical and/or telephone lines, containing chemical preservatives, for example, pentachlorophenol, oils and the like. This method aims at extracting the preservatives from the wood to give a final product which is non toxic and is free from preservatives and is characterized by the following steps:

the wood articles are shredded into chips;

the chips obtained in the preceding step are impregnated with an aqueous alkaline solution until softening of the chips and modification of the chemical state of the products to be extracted;

the softened chips undergo an operation of refining in a crusher, to cause grinding of the wood, resulting in a substantial extraction of the preservatives from the wood particles which are at least partly ground; and the preservatives and the oil are separately collected from the particles of wood in the aqueous phases produced in the steps of impregnation and refining.

DESCRIPTION OF PREFERRED EMBODIMENTS

Reduction of the chips is carried out preferably by means of an industrial shredder known as Morbark model 27 RXL to give chips in which the size varies for example between 1 and 16 mm.

The treatment of chips obtained from the posts with an aqueous alkaline solution, is normally carried out with a diluted solution preferably containing between 1 and 4% by weight of NaOH, and for a period preferably between 1 hour and 24 hours. This alkaline solution causes a swelling of the wood, softens the chips and promotes shredding during the steps of steam cooking-explosive decompression and refining. Although it is not absolutely critical, the impregnation is preferably carried out at about 60° C.

In the case of an industrial application of the process, this time could be reduced by a few hours to a few minutes by means of an impregnation with steam under elevated pressure and temperature.

A better yield may be obtained by introducing between the step of impregnation and that of refining, a step of treatment of the softened chips with vapor saturated steam at a temperature ranging between about 170° C. and 210° C., preferably about 195° C., for example during about 4 to 8 minutes, followed by an explosive decompression at atmospheric pressure to give wood fragments. The steam cooking-explosive decompression technique is for example that described in U.S. Pat. No. 4,798,651, mentioned above.

The extraction of preservatives from the particles of wood is carried out by any means known in the art. Preferably, the chemical preservatives and the oil which are present in the wood are partitioned in the aqueous phase which is in contact with the particles at all stages of the process, for example, during the impregnation of the chips, during their steam cooking-explosive decompression and during their refining. For example, the initial chips, containing 8.7 mg/g of PCP and 99 mg/g of oil loose the equivalent of 2 mg/g of PCP and 7.7 mg/g of oil during the impregnation, 2.6 mg/g of PCP and 18 mg/g of oil during the steam cooking-explosive decompression and 3.7 mg/g of PCP and 27.5 mg/g of oil during refining; while 97% of PCP which is extracted from the chips is recovered in the different aqueous phases, only 50% of the oil which is extracted is recovered. The oil is measured after extraction in an organic phase consisting of Freon 113 ®; the remainder remains in the aqueous phase and is believed to be associated with the saponifiable fraction. On the other hand, the step of impregnation with NaOH as swelling agent enables a better shredding of the wood during explosive-decompression at atmospheric pressure and refining of the chips, which enables to more easily liberate the toxic chemical products which are present in the fibers. On the other hand, the nature of this solution enables to modify the chemical structure of the products to be extracted; pentachlorphenol is transformed into pentachlorophenolate while the oils are partially saponified, which largely promotes their partition into the aqueous phase. At the end of the process, the aqueous phases which are collected during each of the steps (impregnation, steam cooking-explosive decompression and refining) containing PCP in the form of pentachlorphenolate and the saponified oils are collected as one single phase. This solution may be acidified to thereafter be contacted with an oily phase. PCP will be partitioned in the oily phase and it could then be re-used for the treatment of new posts. Another alternative would be to neutralize the solution and to put it in contact with micro-organisms capable of mineralizing PCP either in aerobic or anaerobic mediu, and for this purpose, there would be provided an aqueous solution which can be rejected in the environment without danger of contamination. The chips recovered in the form of fibers at the end of the refining step are thus free from toxic products and may also be discarded in a burying site.

The invention will now be illustrated by the examples which follow, given without limitation.

EXAMPLE 1

A red pin post of an electrical network, was reduced into chips, by utilizing the industrial shredder. 100 g of humid chips (75 g of dry wood) were used and were contacted with 225 g of a 4% weight solution of NaOH during 24 hours at 60° C. This operation was followed by cooking wood with steam at 195° C. during 8 minutes and a sudden decompression at atmospheric pressure, followed by refining-crushing, during 1.5 minutes, by means of a laboratory crusher, Waring model 33BL34 into which was added 2.5 L of water. Following this step, the chips were washed with 2 L of water on a Whatman No. 4 paper filter. The initial quantities of pentachlorophenol and oil in the chips were 8.7 mg/g and 99 mg/g respectively expressed in gram of dry wood. At the end of the operation there were 0.5 mg/g of PCP, and traces of oil for a yield of 94.6% for PCP and close to 100% for the oil. This PCP yield should be considered as minimal due to the fact that a steam impregnation under elevated pressure and the use of an industrial refiner-crusher (for example Sprout-Waldron) would improve the penetration of the alkaline solution in the cellulosic material and consequently the shredding of the chips.

EXAMPLE 2

The test of example 1 was repeated except that the cooking time was 4 minutes. The yields obtained were 96.6% for PCP and close to 100% for the oil.

EXAMPLE 3

Example 1 was repeated, under the same conditions and there is obtained a yield of 96.9% for PCP and close to 100% for the oil.

EXAMPLE 4

Example 1 was repeated, under the same conditions and there is obtained a yield of 97.3% for PCP and close to 100% for the oil.

EXAMPLE 5

Example 1 was repeated, except that the impregnation with an alkaline solution was replaced by an impregnation with water and utilizing a time of cooling of 4 minutes. The yields were 72.3% for PCP and close to 100% for the oil.

EXAMPLE 6

Example 1 was repeated, except that the impregnation with an alkaline solution was replaced by an impregnation with water, the other conditions being the same. The yields obtained were 84.3% for PCP and close to 100% for the oil.

EXAMPLE 7

Example 1 was repeated, without a step of impregnation. The yields obtained were 81.1% for PCP and close to 100% for the oil.

EXAMPLE 8

Example 6 was repeated, without cooking the softened chips at 195° C. The yields obtained were 79.6% for PCP and 86.2% for the oil.

EXAMPLE 9

Example 1 was repeated, without impregnation or cooling. The yields obtained were 10.6% for PCP and 42.9% for the oil.

EXAMPLE 10

Example 1 was repeated, without cooking at 195° C. The yields obtained were 92.7% for PCP and close to 100% for the oil.

A summary of examples 1 to 10 is given in the table which follows. Also, there is a certain number of test (11 to 32) which would tend to show that the steam cooking-explosive decompression step is not absolutely essential if the regulations concerning the environment require that it is sufficient to remove at most about 94% PCP.

The yields of extraction of PCP and the oil (9th and 12th columns of the table) of tests 1 to 32 have been determined by analysis of these analytes in the initial chips and the fibrous material produced by the process according to an experimental protocol published in the Proceedings of the 12th Annual Meeting of Canadian Wood Preservation Association, Vancouver B.C., Nov. 5-5, 1991: "Development and application of an integrated approach to the analysis of PCP and its petroleum solvent in wood, soil and water matrices" in which the authors are A. Besner, P. Tétreault, J. F. Archambault, L. Lépine and R. Gilbert. The oil was analyzed by infrared spectroscopy according to method 503B of APHA (Standard Methods for the Examination of Water and Wastewater, APHA-AWWA-WPCF, 15th edition 1980).

Table of results: Yields of extraction of pentachlorophenol and oil in treated wood

| | Experimental condition | | | | | | | | | | |
|---|---|---|---|---|---|---|---|---|---|---|---|
| | Impregnation | | | Cooking | Refining | [PCP] | [PCP] | | [Oil] | [Oil] | |
| Example | Liquor | duration (hour) | Temperature (°C.) | @ 195° C. (min) | Crusher 1.5 min. | Initial (mg/g) | final (mg/g) | Yield (%) | initial (mg/g) | final (mg/g) | Yield (%) |
| 1 | 4% NaOH | 24 | 60 | 8 | yes | 8.68 | 0.47 | 94.6 | 98.7 | <0.1 | >99.9 |
| 2 | 4% NaOH | 24 | 60 | 4 | yes | 8.68 | 0.30 | 96.6 | 98.7 | <0.1 | >99.9 |
| 3 | 4% NaOH | 24 | 60 | 8 | yes | 8.68 | 0.27 | 96.9 | 98.7 | <0.1 | >99.9 |
| 4 | 4% NaOH | 24 | 60 | 8 | yes | 8.68 | 0.24 | 97.3 | 98.7 | <0.1 | >99.9 |
| 5 | Water | 24 | 60 | 4 | yes | 8.68 | 2.40 | 72.3 | 98.7 | <0.1 | >99.9 |
| 6 | Water | 24 | 60 | 8 | yes | 8.68 | 1.37 | 84.3 | 98.7 | <0.1 | >99.9 |
| 7 | None | — | — | 8 | yes | 8.68 | 1.64 | 81.1 | 98.7 | <0.1 | >99.9 |
| 8 | Water | 24 | 60 | no | yes | 6.92 | 1.41 | 79.6 | 85.9 | 11.9 | 86.2 |
| 9 | None | — | — | no | yes | 6.92 | 6.19 | 10.6 | 85.9 | 49.1 | 42.9 |
| 10 | 4% NaOH | 24 | 60 | no | yes | 6.92 | 0.50 | 92.7 | 85.9 | <0.1 | >99.9 |
| 11 | 4% NaOH | 24 | 60 | no | yes | 8.58 | 0.75 | 91.2 | 81.9 | <0.1 | >99.9 |
| 12 | 4% NaOH | 24 | 60 | no | yes | 8.58 | 0.89 | 89.6 | 81.9 | <0.1 | >99.9 |
| 13 | 1% NaOH | 24 | 60 | no | yes | 8.58 | 0.72 | 91.6 | 81.9 | <0.1 | >99.9 |
| 14 | 1% NaOH | 24 | 60 | no | yes | 8.58 | 0.58 | 93.2 | 81.9 | <0.1 | >99.9 |
| 15 | 1% NaOH | 24 | 60 | no | yes | 8.58 | 0.46 | 94.6 | 81.9 | <0.1 | >99.9 |
| 16 | 0.1% NaOH | 24 | 60 | no | yes | 8.58 | 1.52 | 82.3 | 81.9 | <0.1 | >99.9 |
| 17 | 0.1% NaOH | 24 | 60 | no | yes | 8.58 | 1.64 | 80.9 | 81.9 | <0.1 | >99.9 |
| 18 | 0.1% NaOH | 24 | 60 | no | yes | 8.58 | 1.55 | 81.9 | 81.9 | <0.1 | >99.9 |
| 19 | 4% NaOH | 12 | 60 | no | yes | 8.58 | 0.56 | 93.5 | 81.9 | <0.1 | >99.9 |
| 20 | 4% NaOH | 12 | 60 | no | yes | 8.58 | 0.42 | 95.1 | 81.9 | <0.1 | >99.9 |
| 21 | 4% NaOH | 12 | 60 | no | yes | 8.58 | 0.50 | 94.1 | 81.9 | <0.1 | >99.9 |
| 22 | 4% NaOH | 6 | 60 | no | yes | 8.58 | 0.85 | 90.1 | 81.9 | <0.1 | >99.9 |
| 23 | 4% NaOH | 6 | 60 | no | yes | 8.58 | 0.42 | 95.1 | 81.9 | <0.1 | >99.9 |
| 24 | 4% NaOH | 6 | 60 | no | yes | 8.58 | 0.58 | 93.2 | 81.9 | <0.1 | >99.9 |
| 25 | 4% NaOH | 1 | 60 | no | yes | 8.58 | 0.59 | 93.1 | 81.9 | <0.1 | >99.9 |
| 26 | 4% NaOH | 1 | 60 | no | yes | 8.58 | 0.80 | 90.6 | 81.9 | <0.1 | >99.9 |
| 27 | 4% NaOH | 1 | 60 | no | yes | 8.58 | 0.50 | 94.1 | 81.9 | <0.1 | >99.9 |
| 28 | 4% NaOH | 24 | 20 | no | yes | 8.58 | 0.59 | 93.1 | 81.9 | <0.1 | >99.9 |
| 29 | 4% NaOH | 24 | 20 | no | yes | 8.58 | 0.70 | 91.8 | 81.9 | <0.1 | >99.9 |
| 30 | 4% NaOH | 24 | 20 | no | yes | 8.58 | 0.63 | 92.7 | 81.9 | <0.1 | >99.9 |
| 31 | 4% KOH | 1 | 60 | no | yes | 8.58 | 0.72 | 91.6 | 81.9 | <0.1 | >99.9 |
| 32 | 0.1% KOH | 1 | 60 | no | yes | 8.58 | 2.00 | 76.7 | 81.9 | <0.1 | >99.9 |

We claim:

1. Method for extracting chemical preservatives from wood article, said wood being impregnated with chemical preservatives selected from the group consisting of pentachlorophenol, creosote, oils, and mixtures thereof which comprises the following steps:

a. shredding said wood articles to form wood chips;

b. impregnating the wood chips obtained in the course of the previous step with an aqueous solution essentially containing an alkali hydroxide, under conditions enabling softening of the chips and modification of the chemical state of the preservatives and oils to be extracted;

c. crushing the chips which have been softened by impregnation with said aqueous solution in a crusher for grinding wood, and operating said crusher until substantial removal of said preservatives and oils from particles of wood which have at least been partly ground, and at least about 90 weight percent of said chemical preservatives and substantially all said oils are present in an aqueous phase resulting from said impregnating and crushing steps to obtain a non-toxic cellulosic material; and d. discarding particles of wood obtained by crushing in said crusher and collecting separately from the particles of wood, the chemical preservatives and the oils which are present in the aqueous phase which is obtained in the steps of impregnating and crushing.

2. Method for treating articles of wood according to claim 1, wherein said aqueous solution is a diluted solution of NaOH or KOH.

3. Method for treating articles of wood according to claim 1 wherein said aqueous solution contains 1% to 4% by weight of NaOH or KOH.

4. Method for treating wood articles according to claim 1, wherein previously to step c, there is provided a treatment step with saturated steam in a temperature range between 170° C. and 210° C., followed followed by an explosive decompression giving wood fragments, a portion of the chemical preservatives and of the oil then being present in the aqueous phases formed during the step of steam cooking-explosive decompression.

5. Method for treating wood articles according to claim 4, wherein the treatment with saturated steam is carried out at a temperature of about 195° C. for about 4 to 8 minutes.

6. Method according to claim 1, wherein the impregnation is carried out at between about 20° and 60° for about 1 to 24 hours.

7. Method according to claim 1, wherein the articles of wood comprise wood post or cross pieces.

8. Method according to claim 1, wherein the preservatives is pentachlorophenol, oil or a mixture thereof.

9. Method according to claim 1. wherein the articles of wood are reduced into chips whose sizes vary between 1 to 16 mm.

10. Method according to claim 1, wherein said wood preservatives is a mixture of pentachlorophenol and oils and during step b, pentachlorphenol is converted to pentachlorophenolate while the oils are partly saponified.

* * * * *